US011207891B2

(12) United States Patent
Hagiwara et al.

(10) Patent No.: US 11,207,891 B2
(45) Date of Patent: Dec. 28, 2021

(54) LIQUID DISCHARGING APPARATUS

(71) Applicant: SEIKO EPSON CORPORATION, Tokyo (JP)

(72) Inventors: Hiroyuki Hagiwara, Matsumoto (JP); Nobuaki Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/003,023

(22) Filed: Aug. 26, 2020

(65) Prior Publication Data

US 2021/0060959 A1 Mar. 4, 2021

(30) Foreign Application Priority Data

Aug. 29, 2019 (JP) ..... JP2019-156756

(51) Int. Cl.

| | |
|---|---|
| ***B41J 2/175*** | (2006.01) |
| ***B41J 2/155*** | (2006.01) |
| ***B41J 2/18*** | (2006.01) |
| ***B41J 2/14*** | (2006.01) |

(52) U.S. Cl.

CPC ..... *B41J 2/17523* (2013.01); *B41J 2/14145* (2013.01); *B41J 2/14201* (2013.01); *B41J 2/155* (2013.01); *B41J 2/18* (2013.01); *B41J 2002/14419* (2013.01); *B41J 2202/12* (2013.01); *B41J 2202/20* (2013.01)

(58) Field of Classification Search

CPC .... B41J 2/14145; B41J 2/14201; B41J 2/155; B41J 2/175; B41J 2/17523; B41J 2/18; B41J 2002/14419; B41J 2202/12; B41J 2202/20

See application file for complete search history.

(56) References Cited

U.S. PATENT DOCUMENTS

| | | | | |
|---|---|---|---|---|
| 6,231,174 | B1 * | 5/2001 | Haigo | B41J 2/1652 347/89 |
| 8,172,376 | B2 * | 5/2012 | Nathan | B41J 2/14 347/85 |
| 2009/0096838 | A1 * | 4/2009 | Chino | B41J 2/1408 347/56 |
| 2017/0096015 | A1 * | 4/2017 | Odaka | B41J 2/17509 |

FOREIGN PATENT DOCUMENTS

JP 2017-136720 A 8/2017

* cited by examiner

*Primary Examiner* — Anh T Vo

(74) *Attorney, Agent, or Firm* — Workman Nydegger

(57) ABSTRACT

In the first head unit, the first supply port is positioned on a first side, which is one side of the first direction, and the first exhaust port is positioned on a second side, which is the other side of the first direction with respect to a center of the plurality of first nozzles, and in the second head unit, the second supply port is positioned on the second side and the second exhaust port is positioned on the first side with respect to a center of the plurality of second nozzles. The first head unit and the second head unit are arranged in a second direction intersecting with the first direction.

16 Claims, 13 Drawing Sheets

LIQUID DISCHARGING APPARATUS

The present application is based on, and claims priority from JP Application Serial Number 2019-156756, filed Aug. 29, 2019, the disclosure of which is hereby incorporated by reference here in its entirety.

BACKGROUND

1. Technical Field

The present disclosure relates to a liquid discharging apparatus.

2. Related Art

In the related art, a liquid discharging apparatus that discharges a liquid such as ink is known, as represented by an ink jet type printer. For example, as disclosed in JP-A-2017-136720, a liquid discharging apparatus of this type generally includes a plurality of liquid discharging heads that discharge a liquid and a flow path member that distributes the liquid to the plurality of liquid discharging heads. Each of the plurality of liquid discharging head is provided with a plurality of nozzles for discharging the liquid. The flow path member is provided with a flow path that supplies a liquid from the outside to the plurality of liquid discharging heads. The flow path includes a plurality of branch flow paths that branch corresponding to the plurality of liquid discharging heads.

It is not easy to make the flow path resistances in the plurality of branch flow paths equal to each other, and as a result, pressure differences of liquid may occur between the plurality of liquid discharging heads. Specifically, when the liquid is circulated inside and outside a unit including the liquid discharging head and the flow path member, the pressure difference is likely to appear as a difference in the discharging amount of the liquid from the nozzles between the plurality of liquid discharging heads. When a plurality of units are arranged and used in a direction intersecting an array direction of the nozzles for the purpose of speeding up printing or high resolution, the plurality of units are disposed in the same direction as each other, in the related art. Therefore, in the related art, there is a problem in that the above-mentioned difference in discharging amount is emphasized by the superposition between the units, and as a result, the printing quality is deteriorated.

SUMMARY

To solve the above problem, according to an aspect of the present disclosure, there is provided a liquid discharging apparatus including: a first head unit provided with a plurality of nozzles that discharge a liquid; and a second head unit provided with a plurality of nozzles that discharge the liquid, in which the first head unit includes a plurality of first nozzles arranged in a first direction, a first flow path communicating with the plurality of first nozzles, a first supply port supplying the liquid from outside the first head unit to the first flow path, and a first exhaust port exhausting the liquid from the first flow path to the outside of the first head unit, the second head unit includes a plurality of second nozzles arranged in the first direction, a second flow path communicating with the plurality of second nozzles, a second supply port supplying the liquid from outside the second head unit to the second flow path, and a second exhaust port exhausting the liquid from the second flow path to the outside of the second head unit, in the first head unit, the first supply port is positioned on a first side, which is one side of the first direction, and the first exhaust port is positioned on a second side, which is the other side of the first direction with respect to a center of the plurality of first nozzles, in the second head unit, the second supply port is positioned on the second side and the second exhaust port is positioned on the first side with respect to a center of the plurality of second nozzles, and the first head unit and the second head unit are arranged in a second direction intersecting with the first direction.

DESCRIPTION OF EXEMPLARY EMBODIMENTS

Figure 2:
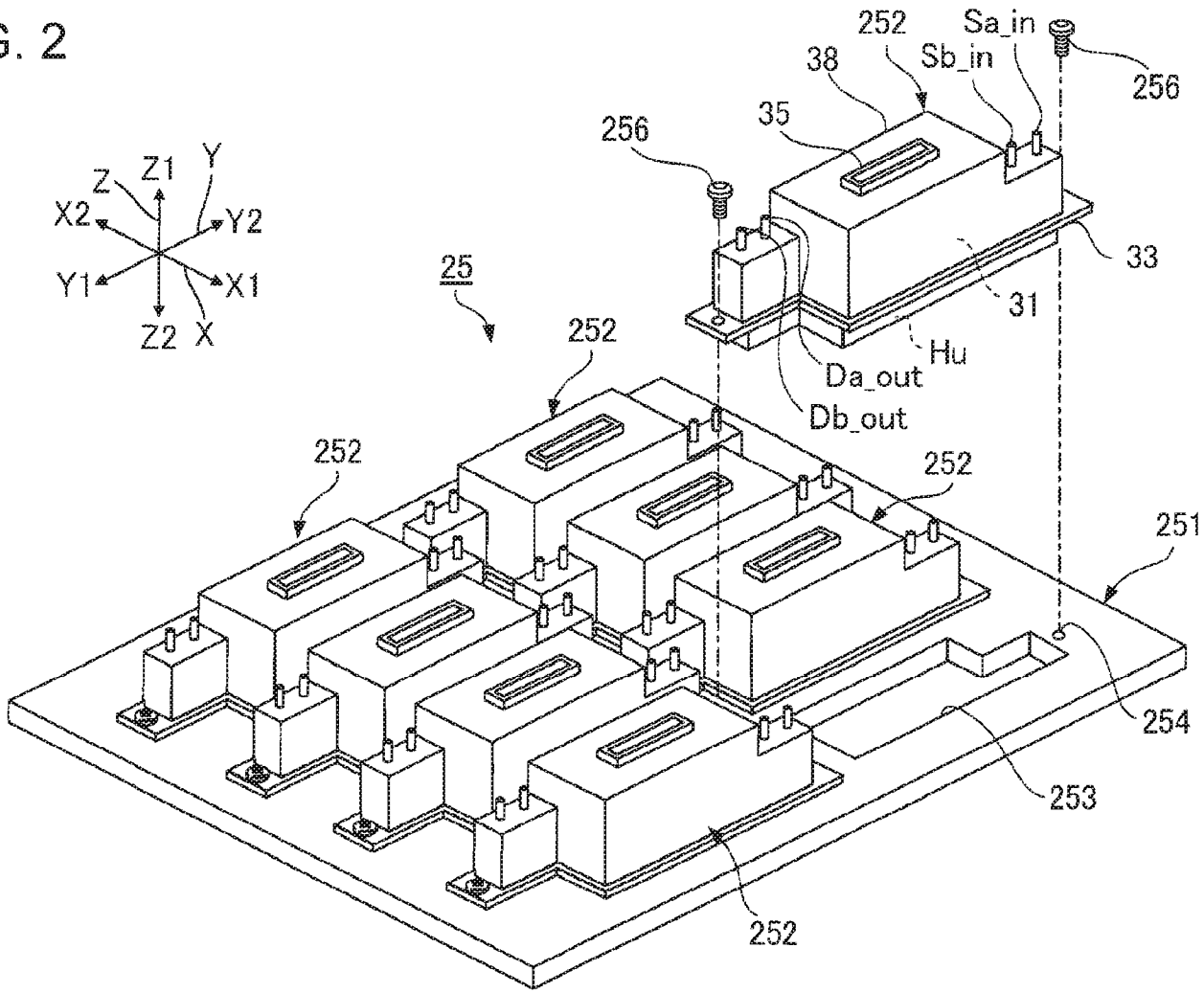
FIG. 2 is a perspective view of a head module.

In the following description, an X axis, a Y axis, and a Z axis that are orthogonal to each other are assumed. As illustrated in FIG. 2, a direction along the X axis when viewed from any point is represented as an X1 direction, and a direction opposite to the X1 direction is represented as an X2 direction. Similarly, directions opposite to each other along the Y axis from any point are represented as Y1 and Y2 directions, and directions opposite to each other along the Z axis from any point are represented as Z1 and Z2 directions. An X-Y plane including the X axis and the Y axis corresponds to a horizontal plane. The Z axis is an axis along the vertical direction, and the Z2 direction corresponds to a lower side in the vertical direction. The X axis, the Y axis, and the Z axis may intersect each other at an angle of approximately 90 degrees.

1. First Embodiment 1-1. Liquid Discharging Apparatus 100

Figure 1:
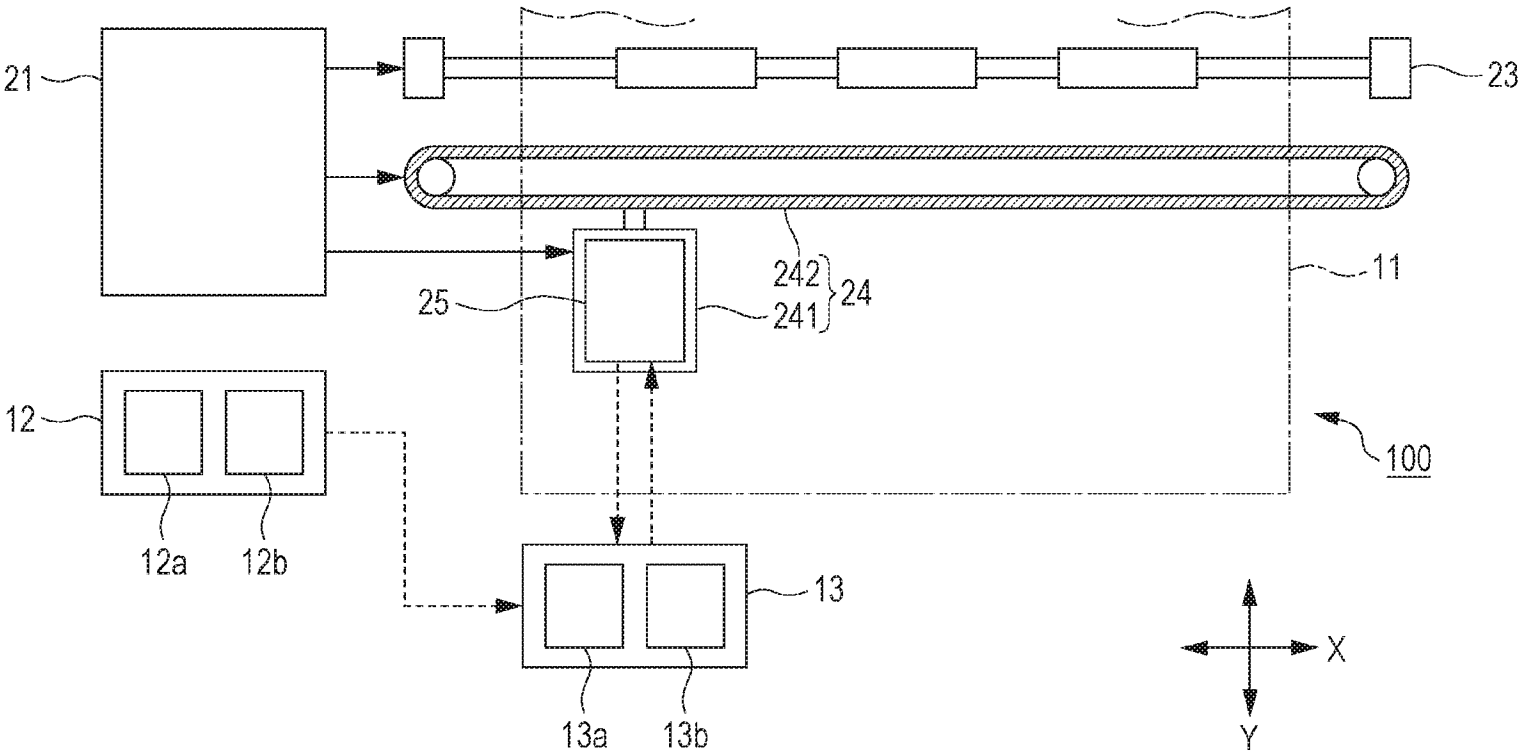
FIG. 1 is a schematic view illustrating a configuration of a liquid discharging apparatus according to a first embodiment.

FIG. 1 is a schematic view illustrating a configuration of a liquid discharging apparatus 100 according to a first embodiment. The liquid discharging apparatus 100 is an ink jet type printing apparatus that discharges an ink, which is an example of a liquid, as droplets onto a medium 11. The medium 11 is typically a printing paper. However, a printing target made of any material such as a resin film or cloth may be used as the medium 11, for example.

As illustrated in FIG. 1, the liquid discharging apparatus 100 is provided with a liquid container 12 that stores the ink. For example, a cartridge that is attachable to and detachable from the liquid discharging apparatus 100, a bag-shaped ink pack made of a flexible film, or an ink tank that can be replenished with an ink is used as the liquid container 12. As illustrated in FIG. 1, the liquid container 12 includes a liquid container 12*a* and a liquid container 12*b*. A first ink is stored in the liquid container 12*a*, and a second ink is stored in the liquid container 12*b*. The first ink and the second ink are different types of ink. As an example of the first ink and the second ink, there are cases where the first ink is cyan ink and the second ink is magenta ink.

The liquid discharging apparatus 100 is provided with a sub tank 13 that temporarily stores an ink. The ink supplied from the liquid container 12 is stored in the sub tank 13. The sub tank 13 includes a sub tank 13*a* that stores the first ink and a sub tank 13*b* that stores the second ink. The sub tank 13*a* is coupled to the liquid container 12*a*, and the sub tank 13*b* is coupled to the liquid container 12*b*. Further, the sub tank 13 is coupled to a head module 25, supplies ink to the head module 25, and collects the ink from the head module 25. The flow of the ink between the sub tank 13 and the head module 25 will be described in detail later.

As illustrated in FIG. 1, the liquid discharging apparatus 100 includes a control unit 21, a transporting mechanism 23, a moving mechanism 24, and the head module 25. The control unit 21 controls each element of the liquid discharging apparatus 100. The control unit 21 includes, for example, one or a plurality of processing circuits such as a central processing unit (CPU) or a field programmable gate array (FPGA), and one or a plurality of storage circuits such as a semiconductor memory.

The transporting mechanism 23 transports a medium 11 along the Y axis under the control of the control unit 21. The moving mechanism 24 causes the head module 25 to reciprocate along the X axis under the control of the control unit 21. The moving mechanism 24 according to the present embodiment includes a substantially box-shaped transporting body 241 that accommodates the head module 25, and an endless belt 242 to which the transporting body 241 is fixed. The liquid container 12 and the sub tank 13 may be mounted on the transporting body 241 together with the head module 25.

The head module 25 discharges the ink which is supplied from the sub tank 13, from each of a plurality of nozzles onto the medium 11 under the control of the control unit 21. The head module 25 discharges the ink onto the medium 11 in parallel with the transport of the medium 11 by the transporting mechanism 23 and the repeated reciprocation of the transporting body 241, thereby an image is formed on a surface of the medium 11.

FIG. 2 is a perspective view of the head module 25. As illustrated in FIG. 2, the head module 25 includes a support member 251 and a plurality of head units 252. The support member 251 is a plate-shaped member that supports the plurality of head units 252. A plurality of mounting holes 253 and a plurality of screw holes 254 are formed in the support member 251. Each head unit 252 is supported by the support member 251 in a state inserted into the mounting hole 253. The plurality of screw holes 254 are provided in twos in correspondence with each of the mounting holes 253. As illustrated in FIG. 2, each head unit 252 is fixed to the support member 251 by screwing using screws 256 and screw holes 254 at two places. The plurality of head units 252 are arranged in a matrix-shaped along the X axis and the Y axis. However, the number of head units 252 and the aspect of the arrangement of the plurality of head units 252 are not limited to the above example.

1-2. Head Unit 252

Figure 3:
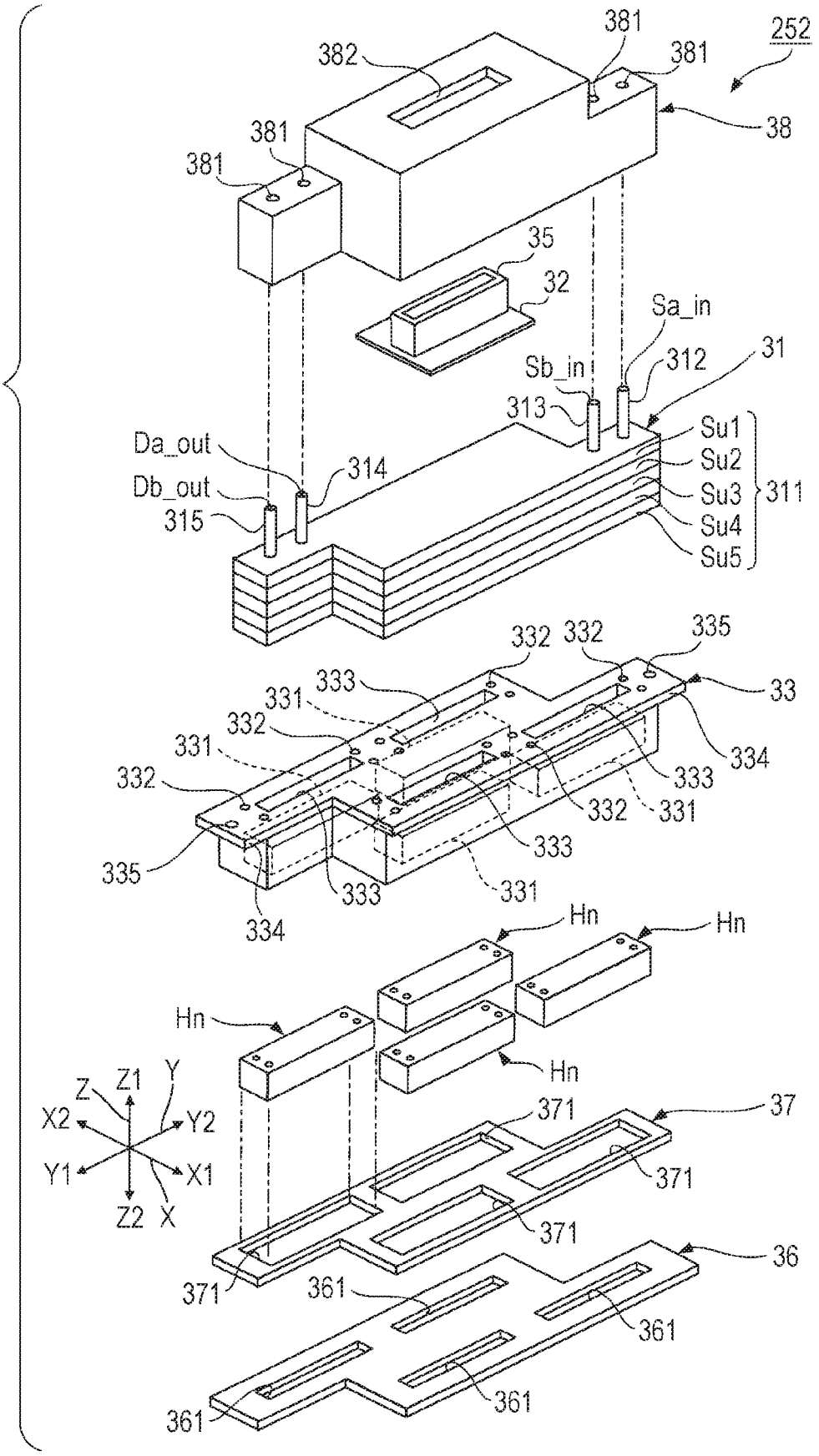
FIG. 3 is a disassembled perspective view of a head unit.

FIG. 3 is a disassembled perspective view of the head unit 252. As illustrated in FIG. 3, the head unit 252 includes a flow path member 31, a wiring substrate 32, a holder 33, a plurality of circulation heads Hn, a fixing plate 36, a reinforcing plate 37, and a cover 38. The flow path member 31 is positioned between the wiring substrate 32 and the holder 33. Specifically, the holder 33 is installed in the Z2 direction with respect to the flow path member 31, and the wiring substrate 32 is installed in the Z1 direction with respect to the flow path member 31. In the present embodiment, the number of circulation heads Hn provided in each head unit 252 is four. In the following, these four circulation heads Hn are also referred to as circulation heads H1, H2, H3, and H4.

The flow path member 31 is a structure having therein a flow path for supplying the ink stored in the sub tank 13 to the plurality of circulation heads Hn. The flow path member 31 includes a flow path structure 311 and connection pipes 312, 313, 314, and 315. Although not illustrated in FIG. 3, the flow path structure 311 is provided with a supply flow path for supplying the first ink to the plurality of circulation heads Hn, a supply flow path for supplying the second ink to the plurality of circulation heads Hn, an exhaust flow path for exhausting the first ink from the plurality of circulation heads Hn, and an exhaust flow path for exhausting the second ink from the plurality of circulation heads Hn. The flow path structure 311 is constituted by laminating the plurality of substrates Su1 to Su5. The plurality of substrates Su1 to Su5 constituting the flow path structure 311 are formed by injection molding of a resin material, for example. The plurality of substrates Su1 to Su5 are bonded to each other by, for example, an adhesive. The flow path structure 311 described above has a longitudinal shape along the Y axis. Connection pipes 312 and 313 are provided in a part at one end of the flow path structure 311 in the longitudinal direction. On the other hand, connection pipes 314 and 315 are provided in a part at the other end of the flow path structure 311 in the longitudinal direction. Each of the connection pipes 312, 313, 314, and 315 is a pipe member protruding from the flow path structure 311. The connection pipe 312 is a supply pipe provided with a supply port Sa_in for supplying the first ink to the flow path structure 311. Similarly, the connection pipe 313 is a supply pipe provided with a supply port Sb_in for supplying the second ink to the flow path structure 311. On the other hand, the connection pipe 314 is an exhaust pipe provided with an exhaust port Da_out for exhausting the first ink from the flow path structure 311. Similarly, the connection pipe 315 is an exhaust pipe provided with an exhaust port Db_out for exhausting the second ink from the flow path structure 311.

The wiring substrate 32 is a mounting component for electrically coupling the head unit 252 to the control unit 21. The wiring substrate 32 is formed of, for example, a flexible wiring substrate, a rigid wiring substrate, or the like. The wiring substrate 32 is disposed on the flow path member 31. One surface of the wiring substrate 32 faces the flow path member 31. A connector 35 is installed on the other surface of the wiring substrate 32. The connector 35 is a coupling component for electrically coupling the head unit 252 and the control unit 21. Further, although not illustrated, wirings coupled to the plurality of circulation heads Hn are coupled to the wiring substrate 32. The wiring is configured with, for example, a combination of a flexible wiring substrate and a rigid wiring substrate. The wiring may be integrated with the wiring substrate 32.

The holder 33 is a structure that accommodates and supports the plurality of circulation heads Hn. The holder 33 is made of, for example, a resin material or a metal material or the like. The holder 33 is provided with a plurality of recess portions 331, a plurality of ink holes 332, a plurality of wiring holes 333, and a pair of flanges 334. Each of the plurality of recess portions 331 is a space that opens in the Z2 direction and in which the circulation head Hn is disposed. Each of the plurality of ink holes 332 is a flow path through which the ink flows between the circulation head Hn disposed in the recess portion 331 and the flow path member 31 described above. Each of the plurality of wiring holes 333 is a hole through which wiring (not shown) that couples the circulation head Hn and the wiring substrate 32 is passed. The pair of flanges 334 is fixing portions for fixing the holder 33 to the support member 251. The pair of flanges 334 illustrated in FIG. 3 is provided with holes 335 for screwing to the support member 251. The above-described screw 256 is passed through the hole 335.

Each circulation head Hn discharges the ink. That is, although not illustrated in FIG. 3, each circulation head Hn has a plurality of nozzles that discharge the first ink and a plurality of nozzles that discharge the second ink. The configuration of the circulation head Hn will be described later.

The fixing plate 36 is a plate member for fixing the plurality of circulation heads Hn to the holder 33. Specifically, the fixing plate 36 is disposed so as to sandwich the plurality of circulation heads Hn with the holder 33, and is fixed to the holder 33 with an adhesive. The fixing plate 36 is made of, for example, a metal material or the like. The fixing plate 36 is provided with a plurality of opening portions 361 for exposing the nozzles of the plurality of circulation heads Hn. In the example of FIG. 3, the plurality of opening portions 361 are individually provided for each circulation head Hn. The opening portion 361 may be shared by two or more circulation heads Hn.

The reinforcing plate 37 is a plate-shaped member that is disposed between the holder 33 and the fixing plate 36 and reinforces the fixing plate 36. The reinforcing plate 37 is arranged on the fixing plate 36 in an overlapping manner and fixed to the fixing plate 36 with an adhesive. The reinforcing plate 37 is provided with a plurality of opening portions 371 in which the plurality of circulation heads Hn are disposed. The reinforcing plate 37 is made of, for example, a metal material or the like. From the viewpoint of reinforcing the fixing plate 36, the thickness of the reinforcing plate 37 is desirably larger than the thickness of the fixing plate 36.

The cover 38 is a box-shaped member that accommodates the flow path structure 311 of the flow path member 31 and the wiring substrate 32. The cover 38 is made of, for example, a resin material or the like. The cover 38 is provided with four through holes 381 and an opening portion 382. The four through holes 381 correspond to the four connection pipes 312, 313, 314, and 315 of the flow path member 31, and a corresponding connection pipe 312, 313, 314, or 315 is passed through each through hole 381. The connector 35 is passed through the opening portion 382 from the inside of the cover 38 to the outside.

Figure 4:
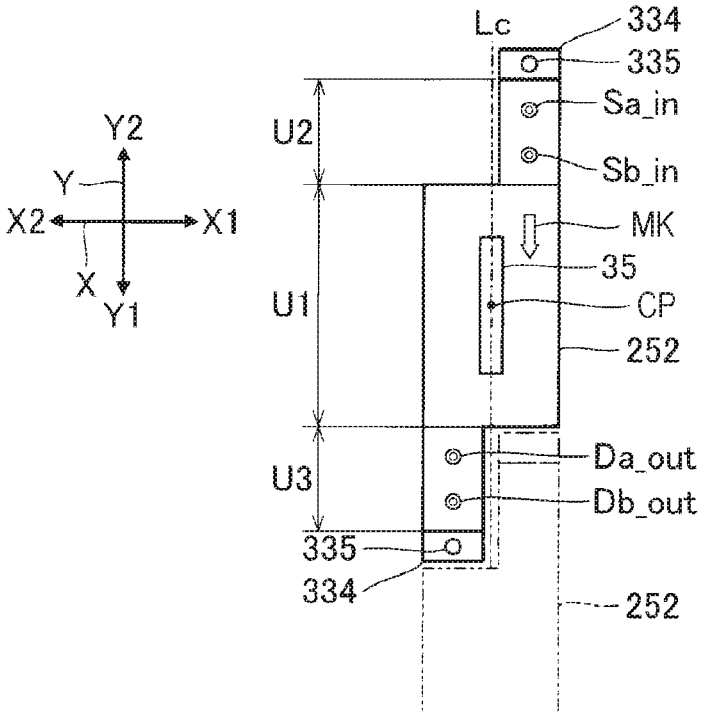
FIG. 4 is a plan view of the head unit as viewed from a Z1 direction.

FIG. 4 is a plan view of the head unit 252 as viewed from the Z1 direction. As illustrated in FIG. 4, each head unit 252 is formed with an outer shape that includes a first part U1, a second part U2, and a third part U3 when viewed from the Z1 direction. The first part U1 is positioned between the second part U2 and the third part U3. Specifically, the second part U2 is positioned in the Y2 direction with respect to the first part U1, and the third part U3 is positioned in the Y1 direction with respect to the first part U1. In the present embodiment, each of the flow path member 31 and the holder 33 is formed with an outer shape corresponding to the head unit 252 when viewed from the Z1 direction. The wiring substrate 32 is formed with an outer shape corresponding to the first part U1 when viewed from the Z1 direction.

In FIG. 4, a center line Lc, which is a line segment passing through a center of the first part U1 along the Y axis, is illustrated. The second part U2 is positioned in the X1 direction with respect to the center line Lc, and the third part U3 is positioned in the X2 direction with respect to the center line Lc. That is, the second part U2 and the third part U3 are positioned on opposite sides of the X axis with the center line Lc interposed therebetween. As illustrated in FIG. 4, the plurality of head units 252 are arranged along the Y axis so that the third part U3 of each head unit 252 and the second part U2 of the other head unit 252 partially overlap each other along the Y axis.

Figure 5:
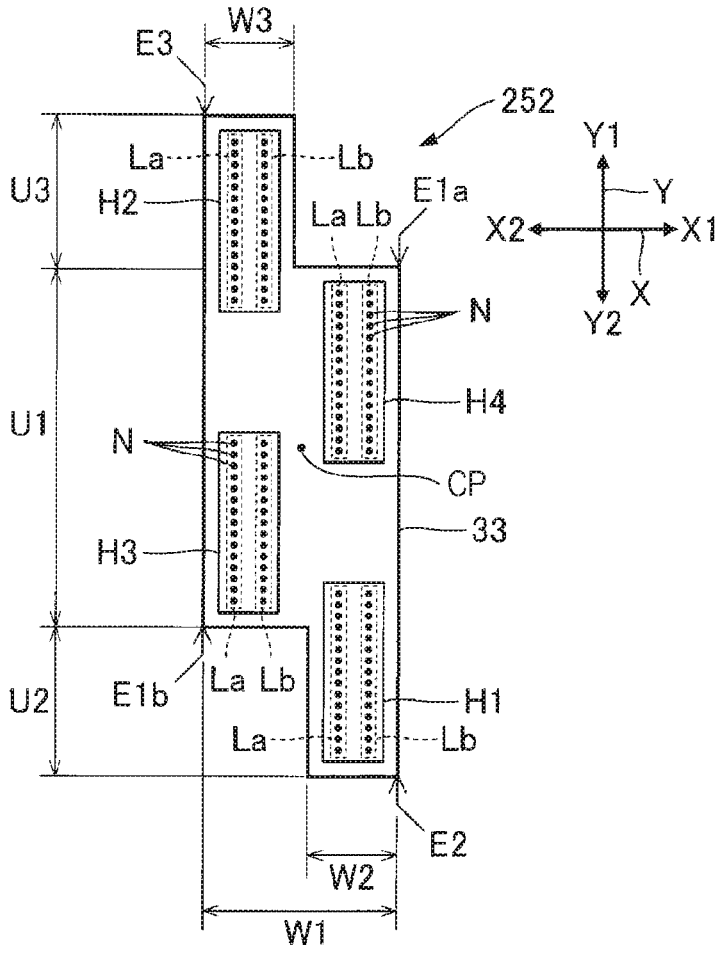
FIG. 5 is a plan view of the head unit as viewed from a Z2 direction.

FIG. 5 is a plan view of the head unit 252 as viewed from the Z2 direction. In FIG. 5, the illustration of the pair of flanges 334 is omitted for convenience of description. As illustrated in FIG. 5, a width W2 of the second part U2 along the X axis is shorter than a width W1 of the first part U1 along the X axis. Similarly, a width W3 of the third part U3 along the X axis is shorter than the width W1 of the first part U1 along the X axis. The width W2 and the width W3 illustrated in FIG. 4 are equal to each other. The width W2 and the width W3 may be different from each other. However, when the width W2 and the width W3 are equal to each other, it is possible to increase the symmetry of the shape of the head unit 252, and as a result, there is an advantage that the plurality of head units 252 can be easily arranged densely. The widths W1, W2, and W3 of the first part U1, the second part U2, and the third part U3 are the widths between one end and the other end along the X axis of each part.

An end surface Ela of the first part U1 in the X1 direction is a plane continuous with an end surface E2 of the second part U2 in the X1 direction. On the other hand, an end surface E1*b* of the first part U1 in the X2 direction is a plane continuous with an end surface E3 of the third part U3 in the X2 direction. A recess portion or a projection portion may be appropriately provided on these end surfaces. Further, a step may be provided between the end surface Ela and the end surface E2, and a step may be provided between the end surface E1*b* and the end surface E3.

As illustrated in FIG. 5, the holder 33 of the head unit 252 holds four circulation heads Hn (n=1 to 4). Each circulation head Hn (n=1 to 4) discharges the ink from a plurality of nozzles N. As illustrated in FIG. 5, the plurality of nozzles N are divided into a nozzle row La and a nozzle row Lb. Each of the nozzle row La and the nozzle row Lb is a set of the plurality of nozzles N arranged along the Y axis. The nozzle row La and the nozzle row Lb are provided side by side with an interval in the direction of the X axis. In the following description, the subscript a is added to the reference symbol of the element related to the nozzle row La, and the subscript b is added to the reference symbol of the element related to the nozzle row Lb.

1-3. Circulation Head Hn

Figure 6:
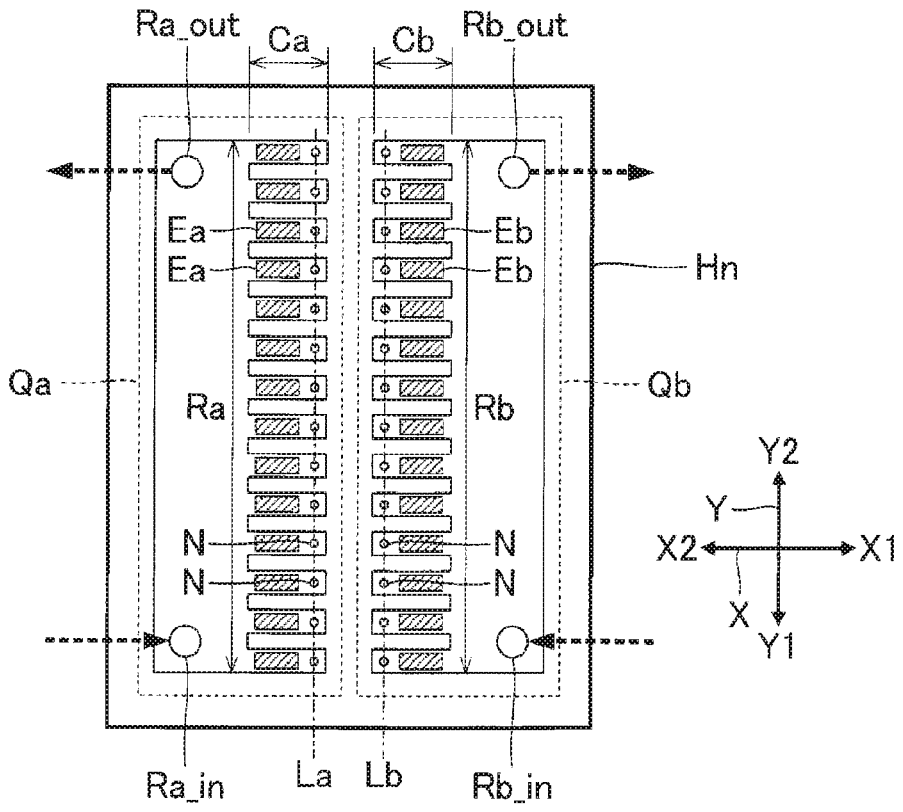
FIG. 6 is a plan view of a circulation head.

FIG. 6 is a plan view of the circulation head Hn. FIG. 6 schematically illustrates the internal structure of the circulation head Hn viewed from the Z1 direction. As illustrated in FIG. 6, each circulation head Hn includes a liquid discharging portion Qa and a liquid discharging portion Qb. The liquid discharging portion Qa of each circulation head Hn discharges the first ink supplied from the sub tank 13*a* from each nozzle N of the nozzle row La. The liquid discharging portion Qb of each circulation head Hn discharges the second ink supplied from the sub tank 13*b* from each nozzle N of the nozzle row Lb.

The liquid discharging portion Qa includes a liquid storage chamber Ra, a plurality of pressure chambers Ca, and a plurality of driving elements Ea. The liquid storage chamber Ra is a common liquid chamber that is continuous over the plurality of nozzles N of the nozzle row La. The pressure chamber Ca and the driving element Ea are formed for each nozzle N of the nozzle row La. The pressure chamber Ca is a space for communicating with the nozzle N. Each of the plurality of pressure chambers Ca is filled with the first ink supplied from the liquid storage chamber Ra. The driving element Ea changes the pressure of the first ink inside the pressure chamber Ca. For example, a piezoelectric element that changes the volume of the pressure chamber Ca by deforming the wall surface of the pressure chamber Ca or a heat generating element that generates bubbles inside the pressure chamber Ca by heating the first ink inside the pressure chamber Ca is desirably utilized as the driving element Ea. The driving element Ea changes the pressure of the first ink in the pressure chamber Ca, and thus the first ink inside the pressure chamber Ca is discharged from the nozzle N.

The liquid discharging portion Qb includes a liquid storage chamber Rb, a plurality of pressure chambers Cb, and a plurality of driving elements Eb, like the liquid discharging portion Qa. The liquid storage chamber Rb is a common liquid chamber that is continuous over the plurality of nozzles N of the nozzle row Lb. The pressure chamber Cb and the driving element Eb are formed for each nozzle N of the nozzle row Lb. Each of the plurality of pressure chambers Cb is filled with the second ink supplied from the liquid storage chamber Rb. The driving element Eb is, for example, the above-described piezoelectric element or heat generating element. The driving element Eb changes the pressure of the second ink inside the pressure chamber Cb, and thus the second ink inside the pressure chamber Cb is discharged from the nozzle N.

As illustrated in FIG. 6, each circulation head Hn is provided with a supply port Ra_in, an exhaust port Ra_out, a supply port Rb_in, and an exhaust port Rb_out. The supply port Ra_in and the exhaust port Ra_out communicate with the liquid storage chamber Ra. The supply port Rb_in and the exhaust port Rb_out communicate with the liquid storage chamber Rb.

The first ink, among the first ink stored in the liquid storage chamber Ra of each circulation head Hn described above, that is not discharged from each nozzle N of the nozzle row La circulates in the path of the exhaust port Ra_out→the exhaust flow path for the first ink of the flow path member 31→the sub tank 13*a* provided outside the head unit 252→the supply flow path for the first ink of the flow path member 31→the supply port Ra_in →the liquid storage chamber Ra. Similarly, the second ink, among the second ink stored in the liquid storage chamber Rb of each circulation head Hn, that is not discharged from each nozzle N of the nozzle row Lb circulates in the path of the exhaust port Rb_out→the exhaust flow path for the second ink of the flow path member 31→the sub tank 13*b* provided outside the head unit 252→the supply flow path for the second ink of the flow path member 31→the supply port Rb_in →the liquid storage chamber Rb.

1-4. Flow Path Member 31

Figure 7:
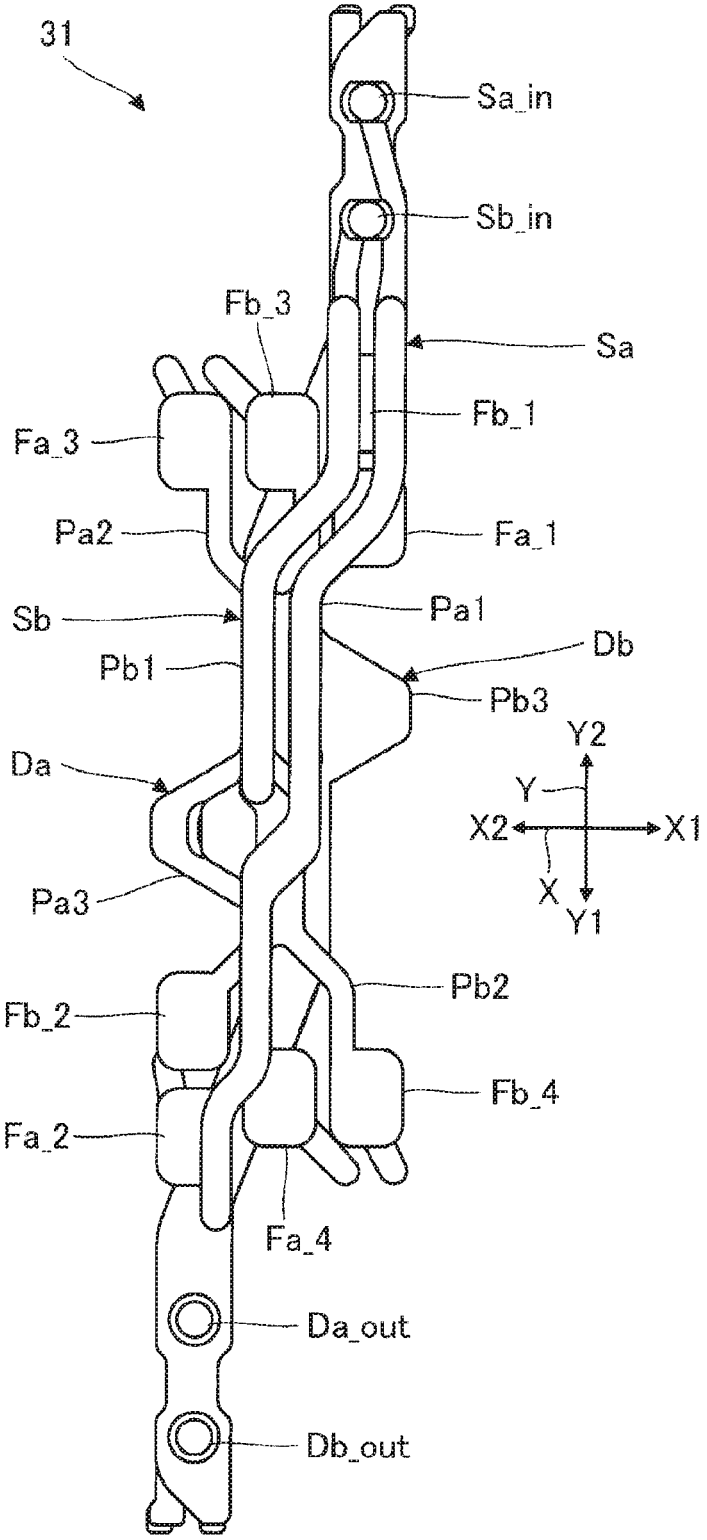
FIG. 7 is a plan view illustrating a flow path provided in a flow path member.
Figure 8:
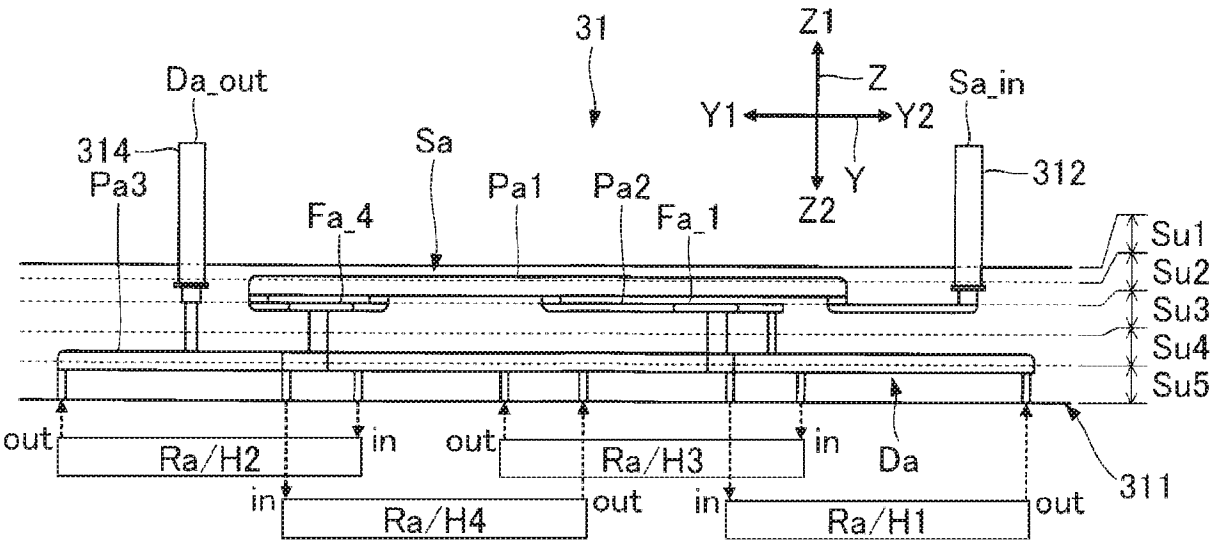
FIG. 8 is a side view of a supply flow path and an exhaust flow path for a first ink among flow paths provided in the flow path member.
Figure 9:
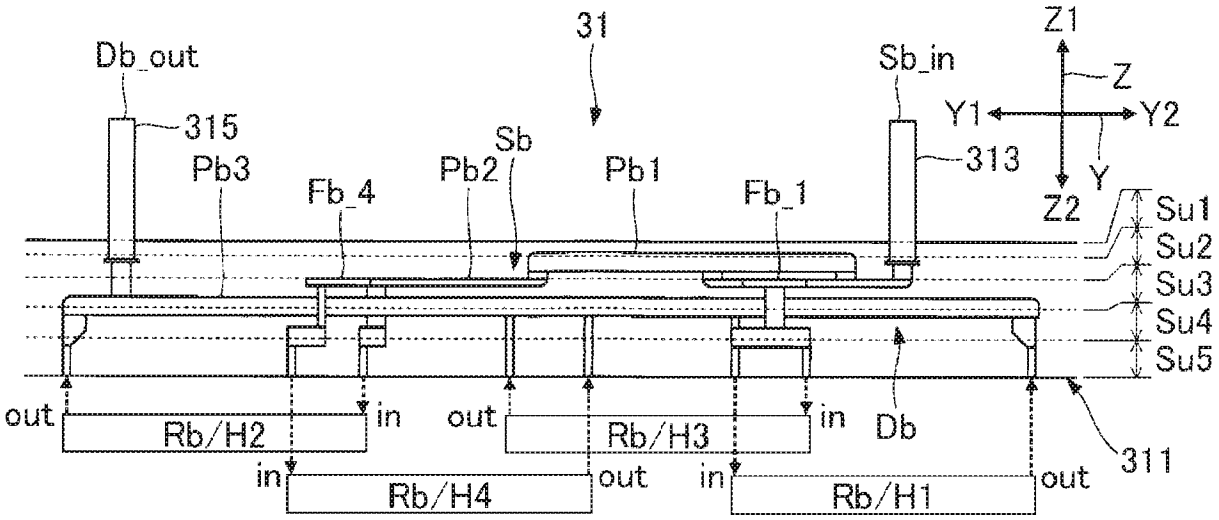
FIG. 9 is a side view of a supply flow path and an exhaust flow path for a second ink among flow paths provided in the flow path member.

FIG. 7 is a plan view illustrating a flow path provided in a flow path member 31. FIG. 8 is a side view of a supply flow path Sa and an exhaust flow path Da for the first ink among flow paths provided in the flow path member 31. FIG. 9 is a side view of a supply flow path Sb and an exhaust flow path Db for the second ink among flow paths provided in the flow path member 31. In FIGS. 8 and 9, the liquid storage chamber Ra of each circulation head Hn is represented by a symbol "Ra/Hn", and the liquid storage chamber Rb of each circulation head Hn is represented by a symbol "Rb/Hn". The configuration of the flow path in the flow path member 31 is not limited to the following configuration.

Inside the flow path member 31, as illustrated in FIG. 7, the supply flow path Sa, the exhaust flow path Da, the supply flow path Sb, and the exhaust flow path Db are provided. The supply flow path Sa is a flow path from the supply port Sa_in to the liquid storage chamber Ra of each circulation head Hn. The exhaust flow path Da is a flow path from the liquid storage chamber Ra of each circulation head Hn to the exhaust port Da_out. The supply flow path Sb is a flow path from the supply port Sb_in to the liquid storage chamber Rb of each circulation head Hn. The exhaust flow path Db is a flow path from the liquid storage chamber Rb of each circulation head Hn to the exhaust port Da_out.

As illustrated in FIGS. 7 and 8, the supply flow path Sa is a flow path that includes a supply portion Pa1, a connection portion Pa2, and four filter portions Fa_1 to Fa_4. As illustrated in FIG. 8, the supply portion Pa1 is formed between the first substrate Su1 and the second substrate Su2. The supply portion Pa1 has a shape extending along the Y axis. The supply port Sa_in communicates with the end of the supply portion Pa1 in the Y2 direction.

The connection portion Pa2 and the four filter portions Fa_1 to Fa_4 are formed between the second substrate Su2 and the third substrate Su3. Each of the filter portions Fa_1 to Fa_4 is provided with a filter that collects foreign matter or bubbles mixed in the first ink. The connection portion Pa2 communicates with the supply portion Pa1 through a through hole formed at the second substrate Su2. The connection portion Pa2 extends in the Y2 direction from a connection position with the supply portion Pa1 and branches into two systems to communicate with the filter portion Fa_1 and the filter portion Fa_3.

The filter portion Fa_2 communicates with the supply portion Pa1 through a through hole formed at the second substrate Su2. The filter portion Fa_4 communicates with the supply portion Pa1 through a through hole formed at the second substrate Su2. Each of the filter portions Fa_1 to Fa_4 communicates with the supply port Ra_in of each circulation head Hn through a through hole that penetrates the third substrate Su3, the fourth substrate Su4, and the fifth substrate Su5.

As illustrated in FIG. 7 and FIG. 9, the supply flow path Sb is a flow path that includes the supply portion Pb1, the connection portion Pb2, and the four filter portions Fb_1 to Fb_4. The supply portion Pb1 is formed between the first substrate Su1 and the second substrate Su2. The supply portion Pb1 has a shape extending along the Y axis. The supply port Sb_in communicates with the end of the supply portion Pb1 in the Y2 direction. The supply portion Pa1 and the supply portion Pb1 are provided side by side between the first substrate Su1 and the second substrate Su2.

The connection portion Pb2 and the four filter portions Fb_1 to Fb_4 are formed between the second substrate Su2 and the third substrate Su3. Each of the filter portions Fb_1 to Fb_4 is provided with a filter that collects foreign matter or bubbles mixed in the second ink. The connection portion Pb2 communicates with the supply portion Pb1 through a through hole formed at the second substrate Su2. The connection portion Pb2 extends in the Y1 direction from a connection position with the supply portion Pb1 and branches into two systems to communicate with the filter portion Fb_2 and the filter portion Fb_4. The connection portion Pb2 extends from the connection position with the supply portion Pb1 in the direction opposite to the connection portion Pa2.

The filter portion Fb_1 communicates with the supply portion Pb1 through a through hole formed at the second substrate Su2. The filter portion Fb_3 communicates with the supply portion Pb1 through a through hole formed at the second substrate Su2. Each of the filter portions Fb_1 to Fb_4 communicates with the supply port Rb_in of each circulation head Hn through a through hole that penetrates the third substrate Su3, the fourth substrate Su4, and the fifth substrate Su5.

As illustrated in FIGS. 7 and 8, the exhaust flow path Da is a flow path that includes an exhaust portion Pa3. The exhaust portion Pa3 is formed between the fourth substrate Su4 and the fifth substrate Su5. The exhaust portion Pa3 has a shape extending along the Y axis over a wider range than the supply portion Pa1. The vicinity of the end portion of the exhaust portion Pa3 in the Y1 direction communicates with the exhaust port Da_out. The exhaust port Ra_out of each circulation head Hn communicates with the exhaust portion Pa3 through a through hole that penetrates the fifth substrate Su5.

As illustrated in FIGS. 7 and 9, the exhaust flow path Db is a flow path that includes the exhaust portion Pb3. The exhaust portion Pb3 is formed between the third substrate Su3 and the fourth substrate Su4. The exhaust portion Pb3 has a shape extending along the Y axis over a wider range than the supply portion Pb1. The vicinity of the end portion of the exhaust portion Pb3 in the Y1 direction communicates with the exhaust port Db_out. The exhaust port Rb_out of each circulation head Hn communicates with the exhaust portion Pb3 through a through hole that penetrates the fourth substrate Su4 and the fifth substrate Su5.

1-5. Variations of Discharging Amount in Head Unit 252

When the head unit 252 as described above is used, the circulation heads Hn provided in one head unit 252 may cause variations in the discharging amount of ink. More specifically, among the liquid circulation heads H1 to H4, there is a difference between the discharging amounts of the liquid from the circulation heads H1 and H3, and the discharging amounts of the liquid from the circulation heads H2 and H4. It is considered that this is due to the difference in the configuration of the flow paths in the flow path member 31.

For example, as can be seen from FIGS. 7 to 9, the ink flowing through the supply flow path Sa is supplied from the supply port Sa_in and then travels in the supply portion Pa1 in the Y1 direction along the Y axis. After that, the ink flows from the supply portion Pa1 toward the circulation heads H1 and H3 through the flow path branched in the Z2 direction in the vicinity of the connection portion Pa2. At this time, immediately after passing through the vicinity of the connection portion Pa2, the ink flows in the Y2 direction, that is, in the direction opposite to that when flowing in the supply portion Pa1.

On the other hand, the ink that does not flow toward the circulation heads H1 and H3 continues further toward the Y1 direction, and then flows to the circulation heads H2 and H4. As described above, in the circulation heads H1 and H3, and the circulation heads H2 and H4, the flow path resistance, the direction of the ink flow, the length of the flow path, and the like are completely different until when the liquid reaches each circulation head Hn from the supply port Sa_in. As a result, even when the same drive signal is input to the one driving element Ea, Eb in each circulation head Hn, a difference occurs in the discharging amount of the ink from the nozzle N corresponding to the one driving element Ea, Eb between the circulation heads H1 and H3, and the circulation heads H2 and H4.

1-6. Disposition of Head Unit 252

Figure 10:
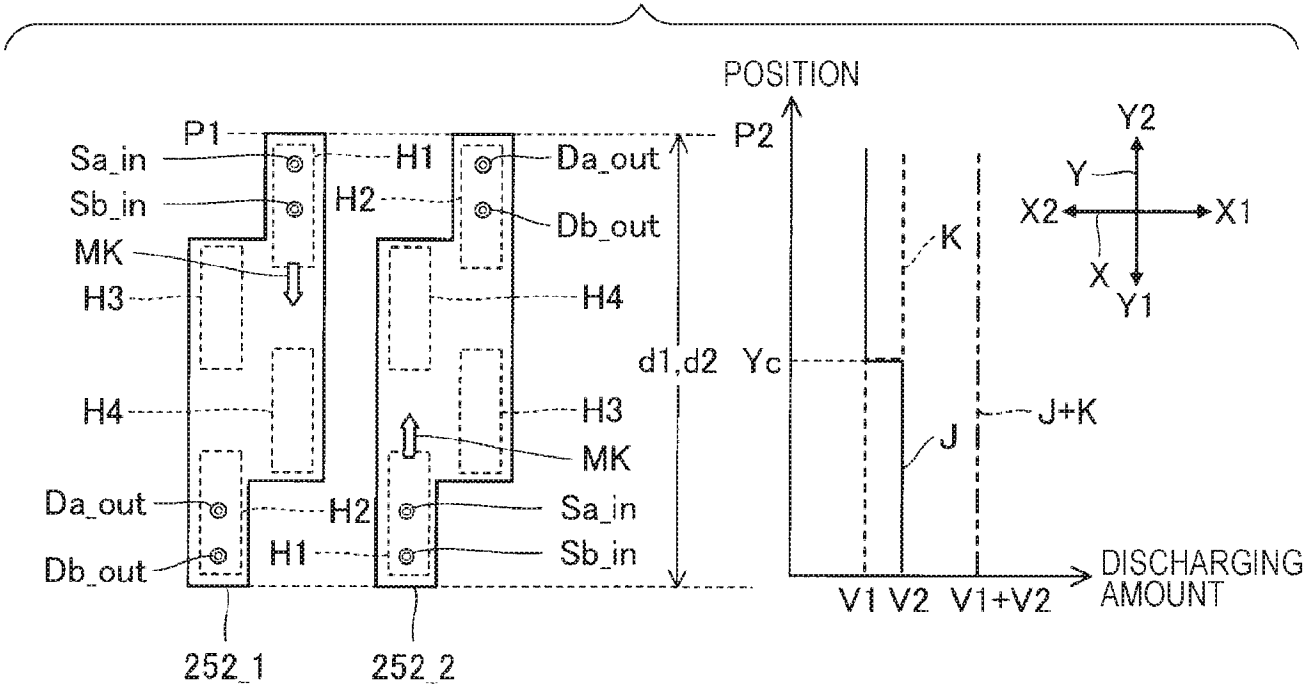
FIG. 10 is a diagram illustrating a relationship between a position on the Y axis and a discharging amount of liquid for the two head units in the first embodiment.

FIG. 10 is a diagram illustrating a relationship between a position on the Y axis and a discharging amount of ink for the two head units 252 in the first embodiment. In the following description, when referring to the discharging amount of the ink, it is assumed that a certain one and the same drive signal is input, unless otherwise specified. Further, in the following description, a case where the discharging amount of the ink in the circulation heads H1 and H3 is smaller than the discharging amount of the ink in the circulation heads H2 and H4 is illustrated.

In FIG. 10, among the plurality of head units 252 supported by the support member 251, the two head units 252 arranged along the X axis are representatively illustrated as head units 252_1 and 252_2. The head unit 252_1 is an example of a first head unit, and the head unit 252_2 is an example of a second head unit. In the present embodiment, a position P1 of the head unit 252_1 coincides with a position P2 of the head unit 252_2 in the Y1 direction or the Y2 direction.

Although not illustrated, the plurality of head units 252 included in the liquid discharging apparatus 100 are configured by combining a plurality of sets of head units 252_1 and 252_2. However, one or both of the head units 252_1 and 252_2 forming another set may be interposed between the head unit 252_1 and the head unit 252_2 forming a set.

As illustrated in FIG. 10, the head units 252_1 and 252_2 are disposed opposite to each other on the Y axis.

FIG. 10 illustrates that a change J in discharging amount of the ink from each nozzle of the head unit 252_1 on the Y axis, a change K in discharging amount of the ink from each nozzle of the head unit 252_2 on the Y axis, and a change J+K in total discharging amount of the ink from each nozzle of the head units 252_1 and 252_2 on the Y axis.

As described above, in the head unit 2521, a discharging amount V2 from the circulation heads H2 and H4 is larger than a discharging amount V1 from the circulation heads H1 and H3. Therefore, in the head unit 2521, as indicated in the change J in discharging amount in FIG. 10, the discharging amount V2 is illustrated on the Y1 side from the center Yc of the Y axis, and the discharging amount V1 is illustrated on the Y2 side from the center Yc of the Y axis, thereby at the center Yc of the Y axis, an increase in the discharging amount of V2−V1 occurs from the Y2 side to the Y1 side.

On the other hand, in the head unit 252_2, the discharging amount from the circulation heads H1 to H4 is the same as that of the head unit 2521, but the head unit 252_1 is disposed in the opposite direction to the Y axis. That is, the circulation head H2 of the head unit 252_2 corresponds to a region on the medium 11 to which the circulation head H1 of the head unit 252_1 corresponds, and the circulation head H3 of the head unit 252_2 corresponds to a region on the medium 11 to which the circulation head H4 of the head unit 252_1 corresponds. Therefore, as indicated in the change K in discharging amount in FIG. 10, the discharging amount V1 is illustrated on the Y1 side from the center Yc of the Y axis, and the discharging amount V2 is illustrated on the Y2 side from the center Yc of the Y axis, thereby at the center Yc of the Y axis, a decrease in the discharging amount of V2−V1 occurs from the Y2 side to the Y1 side.

As a result, as indicated in the change J+K in total discharging amount in FIG. 10, the total discharging amount is equal to V1+V2 regardless of the position of the Y axis. Therefore, in an image printed on the medium 11, there is no difference in density at the center Yc of the Y axis, and the image quality is less likely to deteriorate.

Reference Example

Figure 11:
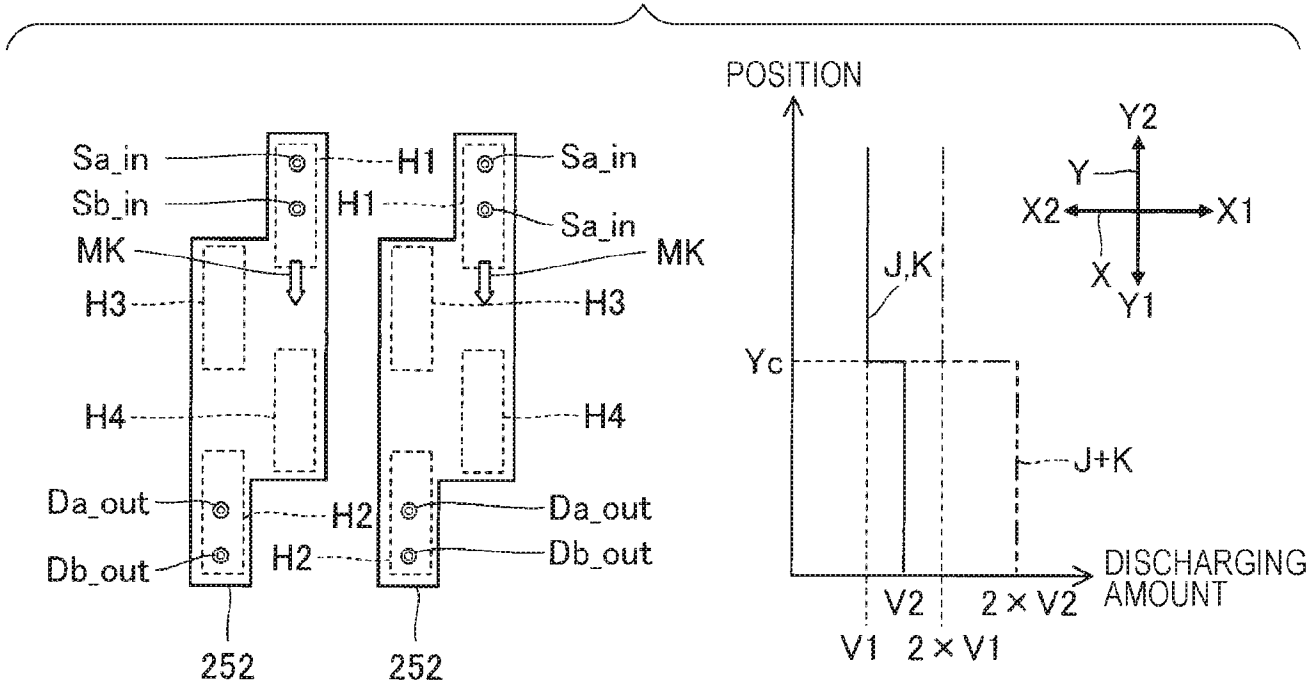
FIG. 11 is a diagram illustrating a relationship between a position on the Y axis and a discharging amount of liquid for two head units when the head units are disposed in the same direction with each other.

FIG. 11 is a diagram illustrating a relationship between a position on the Y axis and a discharging amount of ink for the two head units 252 in Reference Example. As illustrated in FIG. 11, the two head units 252 are disposed in the same direction as each other.

In this case, in the head unit 252_1 and the head unit 252_2, the circulation head Hn having the same discharging amount corresponds to the same region on the medium 11. That is, the circulation head H1 of the head unit 252_2 corresponds to a region on the medium 11 to which the circulation head H1 of the head unit 252_1 corresponds, and the circulation head H4 of the head unit 252_2 corresponds to a region on the medium 11 to which the circulation head H4 of the head unit 252_1 corresponds. Therefore, in both head unit 252_1 and head unit 252_2, as indicated in the change K in discharging amount and in the change J in discharging amount in FIG. 11, the discharging amount V2 is illustrated on the Y1 side from the center Yc of the Y axis, and the discharging amount V1 is illustrated on the Y1 side from the center Yc of the Y axis, thereby at the center Yc of the Y axis, an increase in the discharging amount of V2−V1 occurs from the Y2 side to the Y1 side.

As a result, as indicated in the change J+K in discharging amount in FIG. 11, 2×V1 is obtained on the Y2 side from the center Yc of the Y axis and 2×V2 is obtained on the Y1 side from the center Yc of the Y axis. Therefore, in an image printed on the medium 11, a large difference in density of 2×V2−2×V1 occurs at the center Yc of the Y axis, and the image quality is greatly deteriorated.

In the plurality of head units 252 included in the liquid discharging apparatus 100, there are a plurality of head units 252 disposed in the same direction as each other, and the same number of head units 252 are disposed so as to have the relationship illustrated in FIG. 10.

As can be understood from the above, the liquid discharging apparatus 100 has head units 252_1 and 252_2 provided with a plurality of nozzles N that discharge ink, which is an example of a liquid, and the head unit 252_1 corresponds to "a first head unit", and the head unit 252_2 corresponds to "a second head unit".

Each of the head units 252_1 and 252_2 includes a plurality of nozzles N in nozzle rows La and Lb, supply flow paths Sa and Sb, exhaust flow paths Da and Db, supply ports Sa_in and Sb_in, and exhaust ports Da_out and Db_out. The plurality of nozzles N in each of the nozzle rows La and Lb are arranged in the Y1 direction or the Y2 direction. The supply flow path Sa and the exhaust flow path Da communicate with the plurality of nozzles N of the nozzle row La. The supply flow path Sb and the exhaust flow path Db communicate with the plurality of nozzles N of the nozzle row Lb. The supply port Sa_in supplies the ink to the supply flow path Sa from outside the head units 252_1 and 252_2. The supply port Sb_in supplies the ink to the supply flow path Sb from outside the head units 252_1 and 252_2. The exhaust port Da_out exhausts the ink from the exhaust flow path Da to the outside of the head units 252_1 and 252_2. The exhaust port Db_out exhausts the ink from the exhaust flow path Db to the outside of the head units 252_1 and 252_2.

Further, the head units 252_1 and 252_2 are disposed opposite to each other. That is, in the head unit 2521, the supply ports Sa_in and Sb_in are positioned in the Y2 direction and the exhaust ports Da_out and Db_out are positioned in the Y1 direction with respect to the center CP of the plurality of nozzles N. In contrast to this, in the head unit 252_2, the supply ports Sa_in and Sb_in are positioned in the Y1 direction and the exhaust ports Da_out and Db_out are positioned in the Y2 direction with respect to the center CP of the plurality of nozzles N. Thereafter, the head units 252_1 and 252_2 are arranged in the X1 direction or the X2 direction. "a center CP of a plurality of nozzles N" means the geometric center of gravity of the aggregate of the plurality of nozzles N, as illustrated in FIG. 5.

In the liquid discharging apparatus 100, by disposing the head units 252_1 and 252_2 in opposite directions, the difference in ink discharging amount between the circulation heads Hn of the head unit 252_1 and the difference in ink discharging amount between the circulation heads Hn of the head unit 252_2 can be canceled out or reduced. Therefore, it is possible to reduce the deterioration of the printing quality due to the difference in ink discharging amount between the circulation heads Hn of each of the head units 252_1 and 252_2. Hereinafter, the effect, in which the difference in ink discharging amount between the circulation heads Hn of the head unit 252_1 and the difference in ink discharging amount between the circulation heads Hn of the head unit 252_2 can be canceled out or reduced, is also referred to as the "discharging unevenness reducing effect".

The Y1 direction or the Y2 direction corresponds to "a first direction". The Y2 direction corresponds to "a first side" that is one side of the Y1 direction or the Y2 direction, and the Y1 direction corresponds to "a second side" that is the other side of the Y1 direction or the Y2 direction. The X1 direction or the X2 direction corresponds to "a second direction" intersecting the Y1 direction or the Y2 direction.

Further, each of the plurality of nozzles N included in the head unit 252_1 corresponds to "a first nozzle". Each of the flow path constituted by the supply flow path Sa and the exhaust flow path Da, and the flow path constituted by the supply flow path Sb and the exhaust flow path Db, which are included in the head unit 252_1, corresponds to "a first flow path". Each of the supply ports Sa_in and Sb_in included in the head unit 252_1 corresponds to "a first supply port". Each of the exhaust ports Da_out and Db_out included in the head unit 252_1 corresponds to "a first exhaust port". On the other hand, each of the plurality of nozzles N included in the head unit 252_2 corresponds to "a second nozzle". Each of the flow path constituted by the supply flow path Sa and the exhaust flow path Da, and the flow path constituted by the supply flow path Sb and the exhaust flow path Db, which are included in the head unit 2522, corresponds to "a second flow path". Each of the supply ports Sa_in and Sb_in included in the head unit 252_2 corresponds to "a second supply port". Each of the exhaust ports Da_out and Db_out included in the head unit 252_2 corresponds to "a second exhaust port".

In the present embodiment, a position P1 of the head unit 252_1 coincides with a position P2 of the head unit 252_2 in the Y1 direction or the Y2 direction. Therefore, the disposition density of the nozzles N in the X1 direction or the X2 direction can be increased, and as a result, the printing speed can be increased.

Further, as described above, the liquid discharging apparatus 100 further includes the support member 251 that supports the head unit 252_1. The head unit 252_1 has a pair of flanges 334. Of the pair of flanges 334, one flange 334 corresponds to "a first fixing portion" that is capable of fixing the head unit 252_1 to the support member 251 in a first posture, and the other flange 334 corresponds to "a second fixing portion" that is capable of fixing the head unit 252_1 to the support member 251 in a second posture that is different from the first posture. In the present embodiment, the first posture and the second posture are the postures in which the mounting postures of the head unit 252_1 with respect to the support member 251 are 180° different from each other in the XY plane. In this way, the head unit 252_1 is configured so that the mounting posture with respect to the support member 251 can be selected from the first posture and the second posture. Therefore, the head units 252_1 and 252_2 can have the same configuration. As a result, the cost reduction of the liquid discharging apparatus 100 can be achieved as compared with the case where the head units 252_1 and 252_2 have different configurations.

Each of the pair of flanges 334 is provided with a hole 335 for screwing. In contrast to this, the support member 251 has a pair of screw holes 254 corresponding to the pair of holes 335. Of the pair of screw holes 254, one screw hole 254 corresponds to "a first screwing portion" to which the flange 334 is screwed in the above-described first posture, and corresponds to "a second screwing portion" to which the flange 334 is screwed in the above-described second posture. In this way, by sharing the screw holes 254 in the first posture and the second posture, the configuration of the support member 251 can be simplified as compared with the case where the flange 334 is fixed to the support member 251 using different screw holes in the first posture and the second posture.

As illustrated in FIGS. 4 and 10, the head unit 252_1 is provided with an identification portion MK that can identify whether the supply port Sa_in is positioned in the Y2 direction with respect to the center CP. Therefore, even when the head units 252_1 and 252_2 have the same configuration, it is easy to attach the head unit 252_1 to the support member 251 by selecting from the first posture and the second posture. The identification portion MK illustrated in FIG. 4 is an indication indicating a flowing direction of the first ink from the supply port Sa_in to the exhaust port Da_out or a flow direction of the second ink from Sb_in to the exhaust port Db_out. This indication is configured with, for example, a stamp, a print, a sticker, or the like. The indication form such as an indication position or indication content of the identification portion MK is not limited to the example in FIG. 4. For example, the identification portion MK may be an indication indicating that the connection pipe 312 or 313 is the supply port Sa_in or Sb_in, or an indication indicating that the connection pipe 314 or 315 is the exhaust port Da_out or Db_out, or the like.

As illustrated in FIGS. 4 and 5, as described above, each of the head units 252_1 and 252_2 includes the first part U1, and the second part U2 and the third part U3 in which the widths in the X1 direction or the X2 direction are shorter than that of the first part U1. The second part U2 and the third part U3 are different from each other in the position in the Y1 direction or the Y2 direction and the position in the X1 direction or the X2 direction. Since the first part U1, the second part U2, and the third part U3 have the above-described relationship of width and position, the installation space for the head units 252_1 and 252_2 can be reduced in the X1 direction or the X2 direction as compared with the case where each of the head units 252_1 and 252_2 has a simple rectangular shape, for example.

The first part U1 included in the head unit 252_1 corresponds to "a first part" in which a part of the plurality of nozzles N included in the head unit 252_1 is provided. On the other hand, the first part U1 included in the head unit 252_2 corresponds to "a fourth part" in which a part included in the plurality of nozzles N included in the head unit 252_2 is provided. The second part U2 of the head unit 252_1 corresponds to "a second part" in which a part of the plurality of nozzles N included in the head unit 252_1 is provided. On the other hand, the second part U2 of the head unit 252_2 corresponds to "a fifth part" in which a part of the nozzles N included in the head unit 252_2 is provided. The third part U3 of the head unit 252_1 corresponds to "a third part" in which a part of the plurality of nozzles N included in the head unit 252_1 is provided. On the other hand, the third part U3 of the head unit 252_2 corresponds to "a sixth portion" in which a part of the plurality of nozzles N included in the head unit 252_2 is provided.

In the present embodiment, as illustrated in FIGS. 4 and 5, each of the plurality of nozzles N provided in the head units 252_1 and 252_2, is provided in any one of the first part U1, the second part U2, and the third part U3. That is, the nozzles N are not provided in a part other than the first part U1, the second part U2, and the third part U3 in the head unit 252_1 or 252_2. Therefore, it is easy to design the head units 252_1 and 252_2 that can reduce the installation space as described above.

Further, as illustrated in FIGS. 4 and 5, in the head unit 252_1, the second part U2 is coupled to the first part U1 in the Y2 direction with respect to the first part U1. On the other hand, the third part U3 is coupled to the first part U1 in the Y1 direction with respect to the first part U1. Therefore, it is easy to design the head unit 252_1 that can reduce the installation space as described above.

Further, as illustrated in FIG. 5, in the head unit 2521, the end surface E2 of the second part U2 on a third side that is one side of the X1 direction or the X2 direction has the same position as the end surface Ela of the first part U1 on the third side in the X1 direction or the X2 direction. In other words, the end surface E2 and the end surface Ela form a continuous plane. Similarly, the end surface E3 of the third part U3 on a fourth side that is the other side of the X1 direction or the X2 direction has the same position as the end surface E1*b* of the first part U1 on the fourth side in the X1 direction or the X2 direction. Therefore, as compared with the case where a step is provided between the end surface E2 and the end surface Ela or a step is provided between the end surface E3 and the end surface E1*b*, the head unit 252_1 and the head unit 252_2 can be densely disposed in the X1 direction or the X2 direction.

As illustrated in FIG. 5, each of the head units 252_1 and 252_2 includes a circulation head H1 in which one part is positioned in the second part U2 and the other part is positioned in the first part U1, and a circulation head H2 in which one part is positioned in the third part U3 and the other part is positioned in the first part U1. Therefore, the plurality of nozzles N can be evenly disposed along the Y axis over the first part U1, the second part U2, and the third part U3.

The circulation head H1 included in the head unit 252_1 corresponds to "a first head" in which a part of the plurality of nozzles N included in the head unit 252_1 is provided. The circulation head H2 included in the head unit 252_1 corresponds to "a second head" in which a part of the plurality of nozzles N included in the head unit 252_1 is provided. On the other hand, the circulation head H1 included in the head unit 252_2 corresponds to "a third head" in which a part of the plurality of nozzles N included in the head unit 252_2 is provided. The circulation head H2 included in the head unit 252_2 corresponds to "a fourth head" in which a part of the plurality of nozzles N included in the head unit 252_2 is provided.

In the present embodiment, as illustrated in FIG. 5, each of the head units 252_1 and 252_2 has, in addition to the circulation heads H1 and H2 described above, a circulation head H3 positioned in the first part U1 and a circulation head H4 positioned in the first part U1 at a position different from the circulation head H3 in the Y1 direction or the Y2 direction. In the configuration using the circulation heads H1 to H4, compared to the configuration using only the circulation heads H1 and H2, it is possible to increase the number of nozzles N included in the head units 252_1 and 252_2 without increasing the number of nozzles N in the circulation heads H1 and H2. Therefore, it is easy to increase the number of nozzles N included in the head units 252_1 and 252_2.

The circulation head H3 included in the head unit 252_1 corresponds to "a fifth head" in which a part of the plurality of nozzles N included in the head unit 252_1 is provided. The circulation head H4 included in the head unit 252_1 corresponds to "a sixth head" in which a part of the plurality of nozzles N included in the head unit 252_1 is provided. On the other hand, the circulation head H3 included in the head unit 252_2 corresponds to "a seventh head" in which a part of the plurality of nozzles N included in the head unit 252_2 is provided. The circulation head H4 included in the head unit 252_2 corresponds to "an eighth head" in which a part of the plurality of nozzles N included in the head unit 252_2 is provided.

Further, as illustrated in FIG. 3, each of the head units 252_1 and 252_2 further includes a holder 33 in which the circulation heads H1 and H2 are disposed. Therefore, the circulation heads H1 and H2 can be integrated by the holder 33. In addition to the circulation heads H1 and H2, the circulating heads H3 and H4 are disposed in the holder 33 of the present embodiment. Therefore, the circulation heads H1 to H4 are integrated by the holder 33. The holder 33 included in the head unit 252_1 corresponds to "a first holder". On the other hand, the holder 33 included in the head unit 252_2 corresponds to "a second holder".

Further, as illustrated in FIG. 3, each of the head units 252_1 and 252_2 further includes a fixing plate 36 that fixes the circulation heads H1 and H2 to the holder 33. Therefore, the integrity of the circulation heads H1 and H2 can be enhanced as compared with the configuration in which the fixing plate 36 is not used. The fixing plate 36 of the present embodiment fixes the circulation heads H1 and H2 as well as the circulation heads H3 and H4 to the holder 33. Therefore, the integrity of the circulation heads H1 to H4 is enhanced. The fixing plate 36 included in the head unit 252_1 corresponds to "a first fixing plate". On the other hand, the fixing plate 36 included in the head unit 252_2 corresponds to "a second fixing plate".

As illustrated in FIG. 5, each of the circulation heads H1 and H2 has nozzle rows La and Lb. Therefore, the pitch between the nozzles N in the nozzle row La or Lb can be reduced as compared with the configuration in which the nozzle row La or Lb extends over the circulation head H1 and the circulation head H2. Each of the nozzle rows La and Lb included in the head unit 252_1 corresponds to "a first nozzle row" in which a part of the plurality of nozzles N included in the head unit 252_1 is arranged in the Y1 direction or the Y2 direction. On the other hand, each of the nozzle rows La and Lb included in the head unit 252_2 corresponds to "a second nozzle row" in which a part of the plurality of nozzles N included in the head unit 252_2 is arranged in the Y1 direction or the Y2 direction.

2. Second Embodiment

Figure 12:
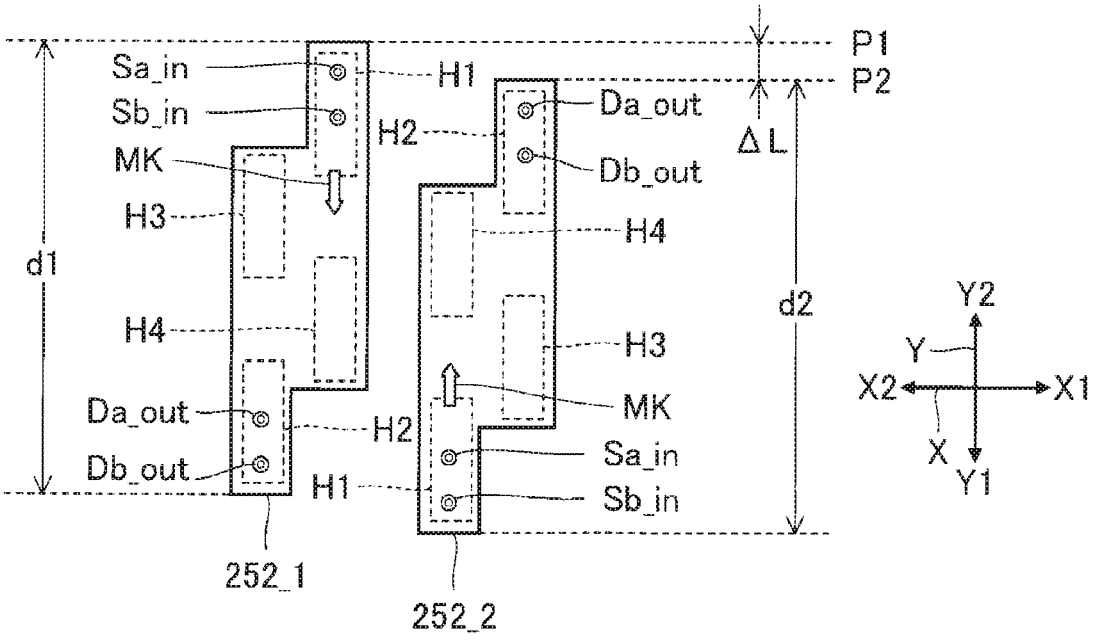
FIG. 12 is a plan view illustrating a disposition of two head units according to a second embodiment.

FIG. 12 is a plan view illustrating a disposition of two head units 252_1 and 252_2 according to a second embodiment. In the present embodiment, a position P1 of the head unit 252_1 differs from a position P2 of the head unit 252_2 in the Y1 direction or the Y2 direction. FIG. 12 illustrates a configuration in which the head unit 252_1 is positioned more Y2 direction side than the head unit 252_2. The head unit 252_1 may be positioned more Y1 direction side than the head unit 252_2. The position P1 is a position defined with reference to a position of the geometric center of gravity of the head unit 252_1 viewed from the Z1 direction or the Z2 direction. The position P2 is a position defined similarly to the position P1 with reference to a position of the geometric center of gravity of the head unit 252_2 viewed from the Z1 direction or the Z2 direction.

When the length of the head unit 252_1 in the Y1 direction or the Y2 direction is denoted by d1, the shift $\Delta L$ between the position P1 of the head unit 252_1 and the position P2 of the head unit 252_2 in the Y1 direction or the Y2 direction is desirably smaller than d1/2. When the shift $\Delta L$ becomes d1/2, that is, when the position P2 of the head unit 252_2 is positioned at the center of the Y axis of the head unit 252_1. In that case, the circulation head H4 of the head unit 252_1 and the circulation head H2 of the head unit 252_2 become at the same position on the Y axis, and the circulation head H2 of the head unit 252_1 and the circulation head H4 of the head unit 252_2 become at the same position on the Y axis. That is, the circulation heads having a large discharging amount are overlapped between the head unit 252_1 and the head unit 252_2. Therefore, the difference in the total discharging amount with respect to other regions becomes large, and there is a possibility that the image quality may deteriorate due to a large difference in density. Therefore, the shift $\Delta L$ is desirably smaller than d1/2. The shift $\Delta L$ is more desirably smaller than d1/4, further desirably smaller than d1/8. By reducing the shift $\Delta L$, the above-described discharging unevenness reducing effect is remarkably exhibited.

As in the present embodiment, in a case where the position P1 and the position P2 in the Y1 direction or the Y2 direction do not coincide and there is a shift $\Delta L$, and when the pitch of the nozzles N in the Y1 direction or the Y2 direction is denoted by LP, it is desirable that $\Delta L \neq Lp \times n$ (n is an integer). When this relationship is satisfied, in the Y1 direction or the Y2 direction, the position of the nozzle N of the head unit 252_1 and the position of the nozzle N of the head unit 252_2 are different, and as a result, the high resolution of the printed image can be achieved. Further, it is desirable that $\Delta L = LP \times (n + 1/2)$. When this relationship is satisfied, in a position of the middle of two nozzles N adjacent to each other in the Y axis of one head unit, one nozzle N of the other head unit is positioned, thereby it is possible to print an image with a higher quality.

However, the relationship of $\Delta L = LP \times n$ may be satisfied. In this case, similarly to the above-described first embodiment, the disposition density of the nozzles N in the X1 direction or the X2 direction can be increased, and as a result, the printing speed can be increased.

When the length of the head unit 252_2 in the Y1 direction or the Y2 direction is denoted by d2, d1=d2. Therefore, the positional shift between the ends of the head units 252_1 and 252_2 in the Y1 direction or the Y2 direction becomes the shift ΔL, and the shift ΔL can be easily adjusted. The length d1 and the length d2 may be different.

3. Modification Example

The form illustrated above may be variously modified. A specific aspect of modification that can be applied to the above-described embodiments is illustrated below. Any two or more aspects selected from the following examples can be appropriately combined within a range not inconsistent with each other.

1. In the above-described embodiment, the number of circulation heads Hn included in one head unit 252 is four, but the number of circulation heads Hn included in one head unit 252 may be three or less or five or more.

Figure 13:
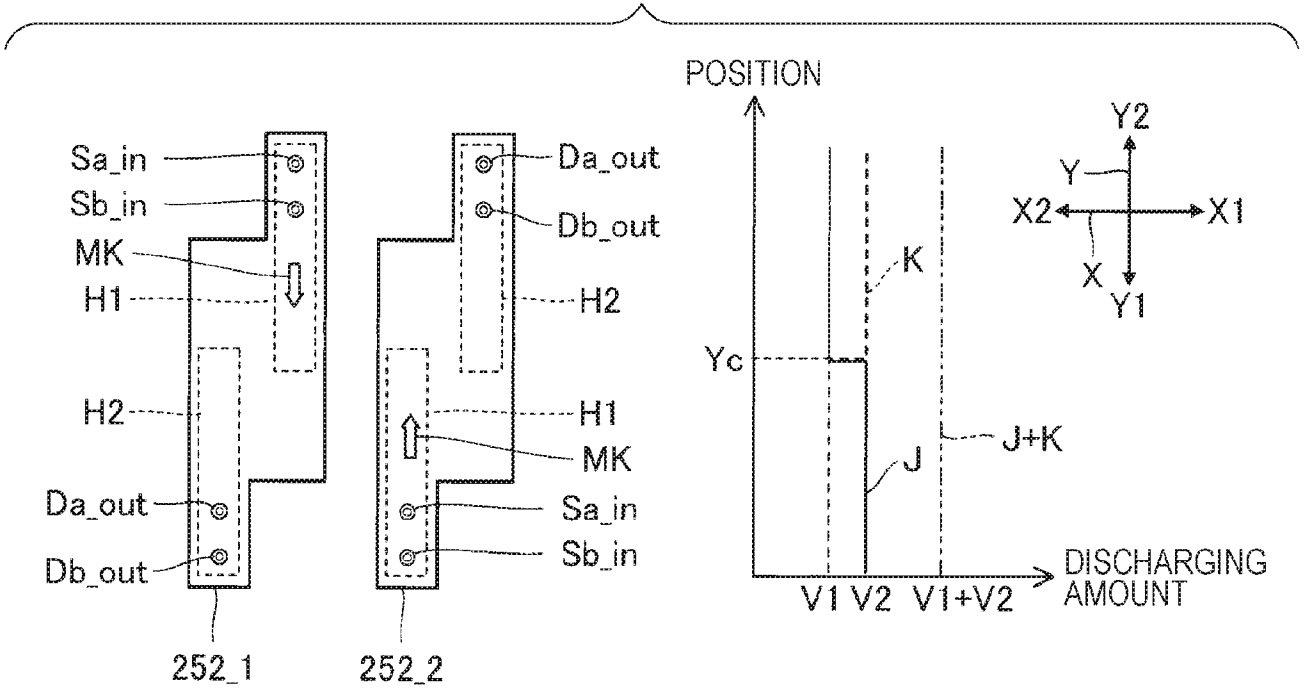
FIG. 13 is a plan view illustrating a disposition of two head units in a modification example.

FIG. 13 is a plan view illustrating a disposition of two head units 252_1 and 252_2 according to a modification example. The head units 252_1 and 252_2 illustrated in FIG. 13 include two circulation heads H1 and H2. In FIG. 13, a case where the discharging amount of the ink in the circulation head H1 smaller than the discharging amount of the ink in the circulation head H2 is illustrated. However, in the present embodiment, a part of the ranges of the circulation heads H1 and H2 in the Y1 direction or the Y2 direction overlap in the first part U1. According to the above modification example, the same effect as the above-described embodiment can be obtained.

2. In the above-described embodiment, the plurality of head units 252 supported by the support member 251 have the same configuration, but the configuration of the head unit 252 corresponding to the first head unit and the configuration of the head unit 252 corresponding to the second head unit may be different from each other.

3. In the above embodiment, different kinds of ink are supplied to the supply flow path Sa and the supply flow path Sb, but the same kind of ink may be supplied to the supply flow path Sa and the supply flow path Sb.

4. In the above-described embodiment, the sub tank 13 is provided outside the head unit 252, and the ink is circulated between the head unit 252 and the sub tank 13, but instead of the sub tank, any system may be used as long as the system circulates ink between the head unit 252 and the outside of the head unit 252. For example, the ink may be circulated between the head unit 252 and the liquid container 12.

5. In the above-described embodiment, the serial type liquid discharging apparatus in which the transporting body 241 having the head unit 252 mounted thereon is reciprocated has been exemplified, but the present disclosure can be applied to a line type liquid discharging apparatus in which a plurality of nozzles N are distributed over the entire width of the medium 11.

6. The liquid discharging apparatus exemplified in the above-described embodiment can be adopted not only in an apparatus dedicated to printing but also in various apparatus such as a facsimile apparatus and a copying machine. Moreover, the application of the liquid discharging apparatus is not limited to printing. For example, a liquid discharging apparatus that discharges a solution of a coloring material is utilized as a manufacturing apparatus that forms a color filter of a display apparatus such as a liquid crystal display panel. Further, a liquid discharging apparatus that discharges a solution of a conductive material is utilized as a manufacturing apparatus that forms wiring or electrodes of a wiring substrate. Further, a liquid discharging apparatus that discharges a solution of an organic substance related to a living body is utilized, for example, as a manufacturing apparatus that manufactures a biochip.

7. The circulation head Hn illustrated in the above-described embodiment is formed by laminating a plurality of substrates, which are not illustrated in the figure, but the above-mentioned each component of the circulation head Hn is appropriately provided. For example, the nozzle row La and the nozzle row Lb are provided on a nozzle substrate. The liquid storage chamber Ra and the liquid storage chamber Rb are provided on a reservoir substrate. The plurality of pressure chambers Ca and the plurality of pressure chambers Cb are provided on a pressure chamber substrate. The plurality of driving elements Ea and the plurality of driving elements Eb are provided on an element substrate. One or more of the above nozzle substrate, reservoir substrate, pressure chamber substrate, and element substrate are individually provided for each circulation head Hn. For example, when the nozzle substrate is provided individually for each circulation head Hn, one or more of the reservoir substrate, the pressure chamber substrate, and the element substrate may be commonly provided for the plurality of circulation heads Hn in the head unit 252. Further, when the reservoir substrate and the pressure chamber substrate are individually provided for each circulation head Hn, the nozzle substrate or the like may be provided commonly for the plurality of circulation heads Hn in the head unit 252. Furthermore, the driving circuits for driving the plurality of driving elements Ea and the plurality of driving elements Eb may be provided individually for each circulation head Hn, or may be provided commonly for the plurality of circulation heads Hn in the head unit 252.

What is claimed is:

1. A liquid discharging apparatus comprising:

a first head unit provided with a plurality of nozzles that discharge a liquid; and a second head unit provided with a plurality of nozzles that discharge the liquid, wherein the first head unit includes a plurality of first nozzles arranged in a first direction, a first flow path communicating with the plurality of first nozzles, a first supply port supplying the liquid from an outside of the first head unit to the first flow path, and a first exhaust port exhausting the liquid from the first flow path to the outside of the first head unit, the second head unit includes a plurality of second nozzles arranged in the first direction, a second flow path communicating with the plurality of second nozzles, a second supply port supplying the liquid from an outside of the second head unit to the second flow path, and a second exhaust port exhausting the liquid from the second flow path to the outside of the second head unit, in the first head unit, the first supply port is positioned on a first side, which is one side of the first direction, and the first exhaust port is positioned on a second side, which is an other side of the first direction with respect to a center of the plurality of first nozzles, in the second head unit, the second supply port is positioned on the second side and the second exhaust port is positioned on the first side with respect to a center of the plurality of second nozzles, and the first head unit and the second head unit are arranged in a second direction intersecting with the first direction.

2. The liquid discharging apparatus according to claim 1, wherein a shift between a position of the first head unit and a position of the second head unit in the first direction is smaller than d1/2, wherein a length of the first head unit in the first direction is d1.

3. The liquid discharging apparatus according to claim 2, wherein d1=d2, wherein a length of the second head unit in the first direction is d2.

4. The liquid discharging apparatus according to claim 1, wherein a position of the first head unit and a position of the second head unit in the first direction coincide with each other.

5. The liquid discharging apparatus according to claim 1, further comprising:

a support member supporting the first head unit, wherein the first head unit further includes a first fixing portion configured to fix the first head unit to the support member in a first posture and a second fixing portion configured to fix the first head unit to the support member in a second posture which is different from the first posture.

6. The liquid discharging apparatus according to claim 5, wherein each of the first fixing portion and the second fixing portion is provided with a hole for screwing, and the support member includes a first screwing portion to which the first fixing portion is screwed in the first posture, and a second screwing portion to which the second fixing portion is screwed in the second posture.

7. The liquid discharging apparatus according to claim 1, wherein the first head unit is provided with an identification portion configured to identify whether the first supply port is positioned on the first side with respect to the center of the plurality of first nozzles.

8. The liquid discharging apparatus according to claim 1, wherein the first head unit has a first part in which a part of the plurality of first nozzles is provided, a second part in which a part of the plurality of first nozzles is provided and a width of the second part is shorter than a width of the first part in the second direction, and a third part in which a part of the plurality of first nozzles is provided, each of a position in the first direction and a position in the second direction is different from that of the second part, and a width of the third part is shorter than a width of the first part in the second direction, and the second head unit has a fourth part in which a part of the plurality of second nozzles is provided, a fifth part in which a part of the plurality of second nozzles is provided and a width of the fifth part is shorter than a width of the fourth part in the second direction, and a sixth part in which a part of the plurality of second nozzles is provided, each of a position in the first direction and a position in the second direction is different from that of the fifth part, and a width is shorter than a width of the fourth part in the second direction.

9. The liquid discharging apparatus according to claim 8, wherein each of the plurality of first nozzles is provided in any of the first part, the second part, and the third part, and each of the plurality of second nozzles is provided in any of the fourth part, the fifth part, and the sixth part.

10. The liquid discharging apparatus according to claim 8, wherein the second part is coupled to the first part on the first side with respect to the first part, and the third part is coupled to the first part on the second side with respect to the first part.

11. The liquid discharging apparatus according to claim 8, wherein an end surface of the second part on a third side that is one side of the second direction has an identical position in the second direction with an end surface of the first part on the third side, and an end surface of the third part on a fourth side that is the other side of the second direction has an identical position in the second direction with an end surface of the first part on the fourth side.

12. The liquid discharging apparatus according to claim 8, wherein the first head unit has a first head in which a part of the plurality of first nozzles is provided, and one part of the first head is positioned in the second part and an other part of the first head is positioned in the first part, and a second head in which a part of the plurality of first nozzles is provided, and one part of the second head is positioned in the third part and an other part of the second head is positioned in the first part, and the second head unit has a third head in which a part of the plurality of second nozzles is provided, and one part of the third head is positioned in the fifth part and an other part of the third head is positioned in the fourth part, and a fourth head in which a part of the plurality of second nozzles is provided, and one part of the fourth head is positioned in the sixth part and an other part of the fourth head is positioned in the fourth part.

13. The liquid discharging apparatus according to claim 12, wherein the first head unit has a fifth head in which a part of the plurality of first nozzles is provided and which is positioned in the first part, and a sixth head in which a part of the plurality of first nozzles is provided and which is different in position from the fifth head in the first direction, and is positioned in the first part, and the second head unit has a seventh head in which a part of the plurality of second nozzles is provided and which is positioned in the fourth part, and an eighth head in which a part of the plurality of second nozzles is provided and which is different in position from the seventh head in the first direction, and is positioned in the fourth part.

14. The liquid discharging apparatus according to claim 12, wherein the first head unit further includes a first holder in which the first head and the second head are disposed, and the second head unit further includes a second holder in which the third head and the fourth head are disposed.

15. The liquid discharging apparatus according to claim 14, wherein the first head unit further includes a first fixing plate that fixes the first head and the second head to the first holder, and the second head unit further includes a second fixing plate that fixes the third head and the fourth head to the second holder.

16. The liquid discharging apparatus according to claim 12, wherein each of the first head and the second head has a first nozzle row in which a part of the plurality of first nozzles is arranged in the first direction, and each of the third head and the fourth head has a second nozzle row in which a part of the plurality of second nozzles is arranged in the first direction.

* * * * *